United States Patent [19]

Stowe

[11] 4,406,973

[45] Sep. 27, 1983

[54] BLACK GLASS SHIELD AND METHOD FOR ABSORBING STRAY LIGHT FOR IMAGE INTENSIFIERS

[75] Inventor: Grady K. Stowe, Dallas, Tex.

[73] Assignee: Varo, Inc., Garland, Tex.

[21] Appl. No.: 466,911

[22] Filed: Feb. 16, 1983

Related U.S. Application Data

[63] Continuation of Ser. No. 225,435, Jan. 15, 1981, abandoned.

[51] Int. Cl.[3] ..... H01J 40/00

[52] U.S. Cl. ..... 313/541; 313/371; 313/532; 313/117

[58] Field of Search ..... 313/371, 116, 117, 524, 313/541, 534, 474

[56] References Cited

U.S. PATENT DOCUMENTS 3,070,720 12/1962 Turk ..... 313/371
4,157,484 6/1979 Stowe et al. ..... 313/94
4,240,694 12/1980 Pan ..... 350/96.16
4,310,778 1/1982 Horseling ..... 313/371

FOREIGN PATENT DOCUMENTS 1582652 1/1981 United Kingdom ..... 313/371

*Primary Examiner*—Alfred E. Smith
*Assistant Examiner*—K. Wieder
*Attorney, Agent, or Firm*—Jerry W. Mills

[57] ABSTRACT

A shielded clear glass cathode substrate (44) is provided for use in an image intensifier tube of the type utilizing a clear glass cathode substrate (46). A black glass cathode substrate shield (48) is coextensive with the entire longitudinal surface of the clear glass cathode substrate (46). The black glass forming the black glass cathode substrate shield (48) has an index of refraction that is greater than the index of refraction of the clear glass utilized in the clear glass cathode substrate (46). A method is provided for producing a shielded glass cathode substrate from a mass of clear glass (52).

16 Claims, 9 Drawing Figures

BLACK GLASS SHIELD AND METHOD FOR ABSORBING STRAY LIGHT FOR IMAGE INTENSIFIERS

This is a continuation of application Ser. No. 225,435 filed Jan. 15, 1981 and now abandoned.

TECHNICAL FIELD

The present invention relates to photocathode internally processed image intensifiers. More specifically, the invention is directed to shielding methods and devices for absorbing stray or off-axis light incident upon the exterior surface of a glass cathode substrate in an image intensifier tube.

BACKGROUND ART

For some time, image intensifier tubes have been used in a variety of applications for direct viewing at low light levels and near infrared regions of the spectrum. Image intensifier tubes have been used in a variety of military, scientific and industrial applications where assistance in viewing objects at low light levels is necessary. For example, the devices are used in military applications to view dimly illuminated targets.

Image intensifier tubes are electro-optical devices which convert a low energy visible or invisible radiant image into an electron image by means of a photocathode. This image is increased in energy and reconstructed by a focusing electric field on a phosphor screen. The radiant image is reconverted on the phosphor screen to a brighter image of varied or like size.

The development of image intensifier tubes has progressed through several generations of units.

In first generation image intensifier tubes, the low light level image is incident upon a fiberoptic face plate which focuses the image on a photocathode where the photon image is converted into an electronic one. The electrons are accelerated toward a phosphor screen while the spatial information is maintained by the electron optics. The accelerated electrons strike the phosphor, thus indicating an amplified image. Generally, three stages of intensifier stages are utilized in the first generation type.

After many years of development, a second generation image intensifier tube was developed. This second generation unit incorporated a micro-channel plate comprised of a bundle of discrete hollow glass tubes or channels capable of amplifying an electron image by many orders of magnitude. As in the first generation of image intensifier tubes, the electron image in the second generation units are generated by a photocathode in response to the incident radiation image. However, the multiplied electron image from the micro-channel plate is directed onto a phosphorus screen for providing an intensified display of the sensed radiation image without the need for stages of amplification.

Research and development efforts for the past several years have been directed in developing new materials for light sensing and detection devices and have produced a third generation image intensifier tube which uses a glass cathode substrate. The most promising materials for such third generation image intensifier tubes are the compounds of gallium arsenide, aluminum gallium arsenide and indium gallium arsenide. Each of these materials is an electro-luminescent type material. These materials can be grown into crystal wafers and bonded to a glass cathode substrate more readily than a fiberoptic material, resulting in a better crystal yield. A successful technique of fabrication utilizes the abovementioned compounds to grow epitaxial layers on single crystal substrates by liquid phase techniques. The liquid phase method is well known and highly developed for small area growths, for example, on the order of 18 milimeter tubes. Thus, the third generation intensifier tube has developed into a wafer intensifier tube that incorporates a microchannel plate which has an ion barrier film of aluminum oxide and a gallium arsenide photocathode. However, internal reflection of off-axis light in the glass cathode substrate reduces the effectiveness of such a design. Therefore, a need exists for a device for preventing off-axis or stray light from being internally reflected in the glass cathode substrate.

DISCLOSURE OF THE INVENTION

In accordance with the present invention, a shielding device is provided for a glass cathode substrate in an image intensifier tube. While the present invention is generally applicable to any type image intensifier tube having a reflective cathode substrate, the invention is particularly suited to the third generation image intensifier tubes having clear glass cathode substrates. The shielding device results in improved performance and serves the purpose of absorbing stray light and preventing light outside the useful area from reaching the photocathode. In accordance with another aspect of the present invention, a method of absorbing off-axis light incident upon the surface of a glass cathode substrate in an image intensifier tube is provided. In still another aspect of the present invention, a method is provided for manufacturing a shielded glass cathode substrate.

In accordance with the shielding device of the present invention, a black glass shield is disposed around the periphery of a glass cathode substrate and adjacent the entire longitudinal surface of the glass cathode substrate. The black glass shield has an index of refraction greater than that of the glass cathode substrate for preventing internal reflection by absorbing stray or off-axis light and improving the performance of the image intensifier tube.

The method of absorbing off-axis light incident upon the surface of a glass cathode substrate in an image intensifier tube includes disposing a black glass shield adjacent and coextensive with the entire longitudinal surface of a glass cathode substrate with the black glass having a higher index of refraction than the glass substrate.

In the process of manufacturing a shielded glass cathode substrate for use in image intensifier tube, an annular channel is formed in a mass of clean glass with the depth of the channel being at least as deep as the desired length of the finished glass cathode substrate. The annular channel defines a cylindrical mass of clear glass of a diameter that is equal to the desired diameter of the clear portion of the glass cathode substrate. The annular channel is then filled at least to a depth that corresponds with the desired length of the finished glass cathode substrate with fluid black glass. Thereafter, the black glass is allowed to solidify to form a resulting mass of clear glass and black glass, with the black glass having a higher index of refraction than the clear glass. The resulting mass is then shaped into the desired configuration such that a clear cylindrical glass cathode substrate is formed having black glass disposed adjacent and coextensive with the cylindrical glass cathode substrate.

BRIEF DESCRIPTION OF THE DRAWINGS

For a more complete understanding of the present invention and further details and advantages thereof, reference is now made to the following description taken into conjunction with the accompanying drawings in which.

DETAILED DESCRIPTION

The present invention provides a shielding device for a glass cathode substrate in a photocathode internally processed image intensifier tube and a method for manufacturing a shielded glass cathode substrate. While the "Detailed Description" herein generally refers to a third generation image intensifier tube, it is to be understood that the invention is not limited to use in such devices, and may be utilized in any image intensifier tube utilizing a reflective cathode substrate.

Figure 1:
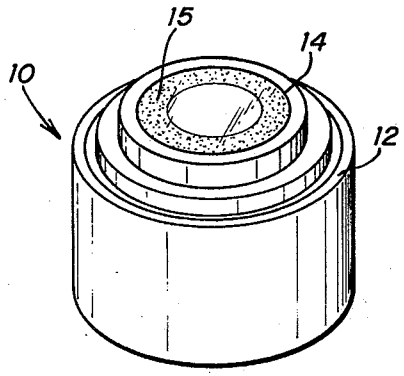
FIG. 1 is a perspective view of a third generation internally processed image intensifier tube in accordance with the present invention.

FIG. 1 illustrates a third generation image intensifier tube incorporating the shielding device of the present invention. The image intensifier tube depicted in FIG. 1 is identified generally by reference numeral 10. Image intensifier tube 10 includes a housing 12 with a photocathode 14 protruding therefrom. A ring 15 of black glass surrounds the peripheral area of the photocathode and serves to absorb light having substantial angles to the axis of the tube 10.

Figure 2:
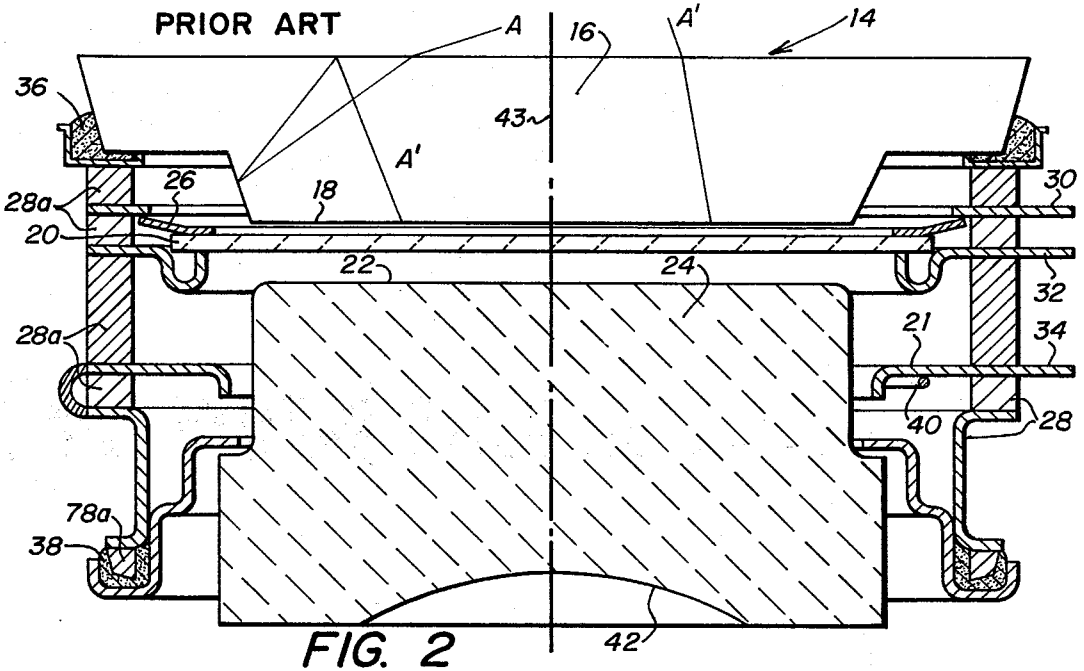
FIG. 2 is a sectional view of a third generation internally processed image intensifier tube of the prior art.

As shown in FIG. 2, a prior art third generation image intensifier tube includes a photocathode 14 with a clear glass cathode substrate 16 and a cathode layer 18. Image intensifier tube 10 also includes a microchannel plate 20, a thin layer phosphor screen 22, a fiberoptics 180° inverter 24, a metal spring 26 for maintaining a specific distance between cathode layer 18 and microchannel plate 20. Other components of image intensifier tube 10 will be hereinafter described.

Another component of image intensifier tube 10 includes a tube body 28. Tube body 28 is generally constructed of 94% aluminum oxide ceramic with "Kovar" and stainless steel electrodes 30, 32 and 34. "Kovar" is a trademark of the Westinghouse Electric Corp. for an iron-nickel-cobalt alloy having thermal expansion characteristics matching those of hard glass. The ceramic portions of tube body 28, identified by reference numeral 28*a*, can be brazed together with the metal electrodes 30, 32 and 34 with a copper gold alloy. The tube body is designed to use cold-pressed indium seals 36 and 38 for maintaining a permanent vacuum tight seal for cathode layer 18 and microchannel plate 20. A vacuum gettering device 40 constructed of titanium and tantalum is located inside the flange of electrode 34. A concave surface 42 is provided on fiberoptic 180° inverter 24 to accept a lens (not shown). The longitudinal axis of the tube is shown as axis 43. A detailed description of the various components and overall operation of image intensifier tube 10 is omitted since the invention is concerned primarily with a shielding device for glass cathode substrate 16.

The fabrication and operation of an image intensifier tube, such as image intensifier tube 10, is known to those skilled in the art. Such a design has advantages over earlier types of image intensifier tubes. However, in order to realize the full advantage of such a design, stray light must be prevented from reaching the photocathode.

As used herein, the terms "stray light" and "off-axis" light are equivalent and mean light that does not impinge upon the cathode substrate 16 generally parallel to the longitudinal axis 43 of the tube 10, or which does not directly impinge upon cathode layer 18. For example, light incident upon glass cathode substrate 16, which does not directly impinge upon cathode layer 18 will be internally reflected within glass cathode substrate 16, thereby reducing the effectiveness of the image intensifier tube. For example, light ray A in FIG. 2 is off-axis light since it does not directly impinge upon cathode layer 18. Light ray A′ is on-axis light since it directly impinges upon cathode layer 18.

In accordance with the present invention, a shielding device is provided that substantially eliminates internally reflected light by absorbing stray or off-axis light thereby preventing light outside the useful area from reaching the photocathode and reducing interference.

Figure 3:
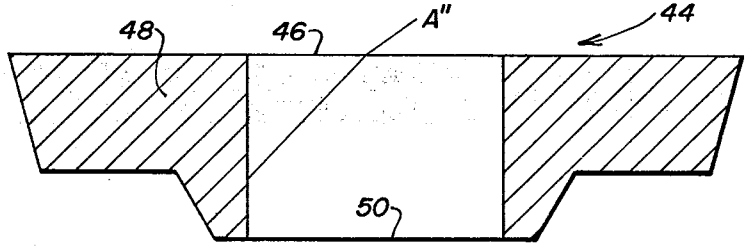
FIG. 3 is a schematic depiction of a shielding device and glass cathode substrate in accordance with the present invention.

FIG. 3 is a sectional view of a photocathode device 44 in accordance with the present invention which includes a clear glass cathode substrate portion 46, a black glass cathode substrate shield 48 and a cathode layer 50. Cathode layer 50 generally includes several thin layers of various materials as described earlier. Often, a layer of silicon nitride is bonded directly to clear glass cathode substrate 46 and black glass cathode substrate shield 48. The silicon nitride layer is generally about 900 angstroms in thickness and acts as an antireflective film to keep light from being reflected towards the object being viewed. A layer of gallium aluminum arsenide approximately 1 micron in thickness is bonded to the silicon nitride layer and a layer of gallium arsenide, generally between about 1 and 1.5 microns in thickness, is bonded to the gallium aluminum arsenide layer.

As shown in FIG. 3, black glass cathode substrate shield 48 is disposed around the entire periphery and adjacent the entire longitudinal surface of clear glass cathode substrate 46 so that any off-axis light will impinge upon black glass substrate shield 48 and be absorbed. Preferably, black glass substrate shield 48 is fused to clear glass cathode substrate 46 so that black glass substrate shield 48 is in intimate contact with clear glass cathode substrate 46. The black glass substrate shield is preferably an annulus disposed adjacent the glass cathode substrate and is coextensive with the entire longitudinal surface of the glass cathode substrate. An off-axis ray of light A″ is shown in FIG. 3 impinging upon clear glass cathode substrate 46 and being absorbed by black glass cathode substrate shield 48.

The black glass utilized to form black glass cathode substrate shield 48 preferably will have an index of refraction greater than the index of refraction of the glass cathode substrate. A suitable type of glass for use as the clear glass cathode substrate is sold by the Corning Glass Works of Corning, New York under the designation Type Number 7056. When this type of glass is utilized for the clear glass cathode substrate, the black glass substrate shield should have an index of refraction of at least 1.53. The thickness of the black glass should preferably be sufficient to absorb substantially all of the off-axis light. Preferably, the black glass has a melting point of about 600° F.

Figure 4A:
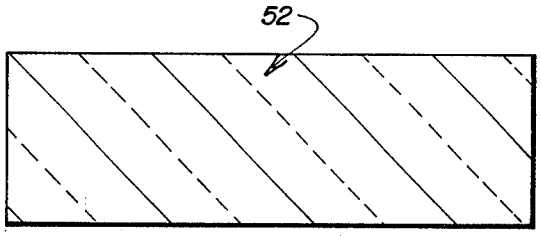
FIGS. 4*a*–4*f* include sectional and perspective views illustrating the manufacture of a shielded glass cathode substrate in accordance with the present invention for an image intensifier tube.
Figure 4B:
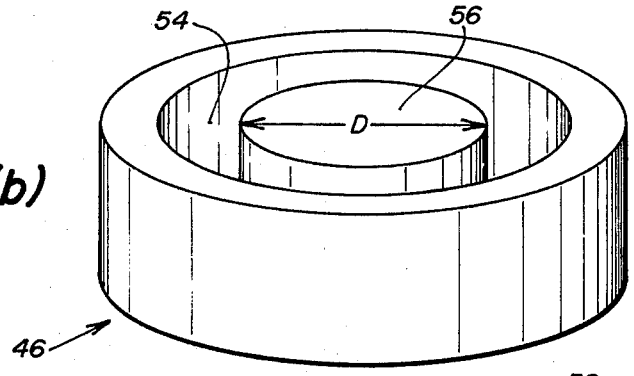

It will be understood that the present shielded glass cathode may be formed in several ways. In accordance with another embodiment of the present invention, a method of producing a shielded glass cathode substrate is provided. Referring to FIGS. 4*a* through 4*f*, there is shown in a shielded glass cathode substrate in various stages of manufacture. In accordance with the method, a mass 52 of clear glass is obtained. The glass forming mass 52 should be of the type and quality that is desired for the glass cathode substrate. It is not necessary that mass 52 be of any particular shape. The size of mass 52 should be as large or larger than each dimension of the desired size of the finished shielded glass cathode substrate. An annular channel 54, shown in FIG. 4*b*, is formed in mass 52. The depth of annular channel 54 is at least as deep as the length of the glass cathode substrate. Annular channel 54 defines a cylindrical mass 56 of clear glass having a diameter D that is equivalent to the desired diameter of the glass cathode substrate. Annular channel 54 can be formed by any suitable method that is known to those skilled in the art, such as by grinding or cutting, for example. Further, if a different shape for the clear glass cathode substrate is desired, a channel of the desired configuration can be formed in mass 56.

Figure 4C:
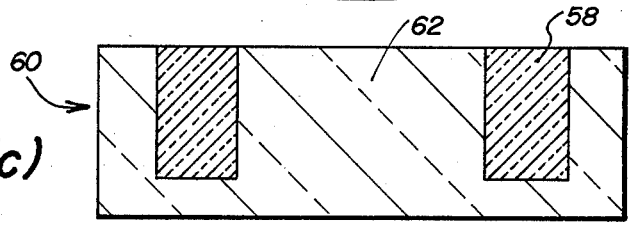

After annular channel 54 has been formed, it is filled with fluid black glass 58 to at least a depth that corresponds with the length of the glass cathode substrate, as shown in FIG. 4*c*. Thereafter, the black glass 58 is allowed to solidify to form a resulting mass 60 of clear glass 62 and black glass 58, with black glass 58 having a higher index of refraction than the clear glass.

Figure 4D:
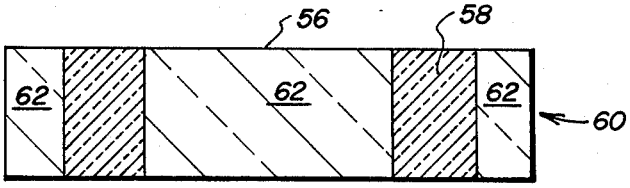
Figure 4E:
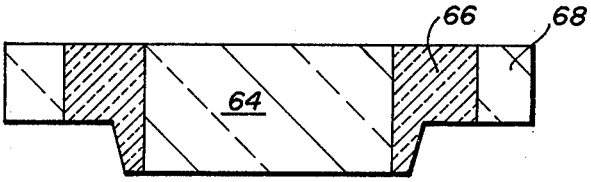
Figure 4F:
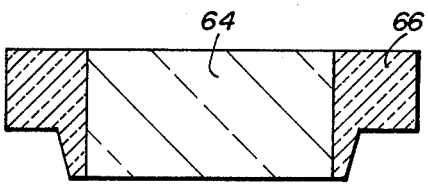

After black glass 58 has solidified, resulting mass 60 is shaped into the desired configuration such that a clear cylindrical glass cathode substrate 64 is formed having a black glass shield 66 disposed adjacent and coextensive with the clear glass cathode substrate. Preferably, the black glass forms an annulus around the clear glass cathode substrate. As shown in FIG. 4*d*, the bottom portion of resulting mass 60 is removed such that black glass 58 extends through the bottom of resulting mass 60. In FIGS. 4*e* and 4*f*, other portions of the remaining glass are removed to form a shielded glass cathode substrate of the desired shape. If desired, a clear glass border 68 can be left as shown in FIG. 4*e* that can be used to facilitate mounting of the substrate, for example.

Although preferred embodiments of the invention have been described in the foregoing detailed description and illustrated in the accompanying drawings, it will be understood that the invention is not limited to the embodiments disclosed, but is capable of numerous rearrangements, modifications, and substitutions of parts and elements without departing from the spirit of the invention. The present invention is therefore intended to encompass such rearrangements, modifications and substitutions of parts and elements as fall within the scope of the appended claims.

I claim:

1. A shielding device for a cathode substrate in an image intensifier tube comprising a shield disposed around the periphery of said cathode substrate and adjacent the entire longitudinal surface of said cathode substrate, said shield having an index of refraction greater than that of said cathode substrate for preventing internal reflection within said cathode substrate by forming an optical interface to reflect and absorb off-axis light that impinges upon the optical interface at an angle of incidence greater than zero degrees after entering said cathode substrate.

2. The shielding device as recited in claim 1 wherein said shield comprises black glass is fused to the cathode substrate.

3. The shielding device as recited in claim 2 wherein said black glass has an index of refraction of greater than about 1.53.

4. In an image intensifier tube having a glass cathode substrate, the improvement comprising a black glass shield disposed adjacent the entire longitudinal surface of the glass cathode substrate, said black glass shield having an index of refraction greater than that of the glass cathode to form an optical interface for refracting off-axis light that impinges upon the optical interface at an angle of incidence greater than zero degrees into said black glass shield for absorbtion thereof, the refraction of off-axis light at the optical interface into said black glass shield preventing internal reflection of light within the glass cathode.

5. The improvement as recited in claim 4 wherein said black glass is fused to the glass cathode substrate.

6. The improvement as recited in claim 4 wherein said black glass has an index of refraction of greater than about 1.53.

7. A shielding device for a cylindrical glass cathode substrate having a cathode surface disposed on the axial surface of one end of the substrate, said shielding device comprising a black glass annulus disposed adjacent the cylindrical glass cathode substrate coextensive with the entire longitudinal surface of the cylindrical glass cathode substrate, said black glass annulus having an index of refraction greater than the index of refraction of said glass cathode substrate to refract light impinging upon the interface between said glass cathode substrate and said black glass annulus on the glass cathode substrate side into said black glass annulus, said black glass annulus absorbing light refracted therein.

8. The shielding device as recited in claim 7 wherein said black glass annulus is fused to the cylindrical glass cathode.

9. The shielding device as recited in claim 7 wherein the index of refraction of the black glass is greater than about 1.53.

10. The shielding device as recited in claim 7 wherein the axial thickness of said annulus is greater at the end of the substrate that is opposite the end on which the cathode is disposed.

11. The shielding device as recited in claim 10 wherein the axial thickness of said annulus constantly increases from the end of the annulus that is adjacent the end of the substrate on which is disposed the cathode over about one-half the length of the substrate.

12. The shielding device as recited in claim 11 wherein the axial thickness of said annulus is essentially constant over the remaining length thereof.

13. The shielding device as recited in claim 12 wherein the ends of said annulus and the ends of the substrate are flat.

14. A method of absorbing off-axis light incident upon the surface of a glass cathode substrate in an image intensifier tube comprising disposing a black glass annulus adjacent and coextensive with the entire longitudinal surface of the glass cathode substrate to form an optical interface, said black glass having a higher index of refraction than the glass substrate in order to refract light entering the glass cathode substrate off-axis thereto into the black glass annulus for absorbtion thereof, the black glass annulus thereby preventing light refraction.

15. The method as recited in claim 14 wherein said black glass is fused to the clear glass cathode substrate.

16. The method as recited in claim 14 wherein the index of refraction of said black glass is at least about 1.53.

* * * * *